US006775859B1

(12) United States Patent
Gorginians

(10) Patent No.: US 6,775,859 B1
(45) Date of Patent: Aug. 17, 2004

(54) DUAL FLUSH TOILET

(76) Inventor: Seroosh Gorginians, 1065 Thompson Ave., Glendale, CA (US) 91201

( * ) Notice: Subject to any disclaimer, the term of this patent is extended or adjusted under 35 U.S.C. 154(b) by 0 days.

(21) Appl. No.: 10/397,444

(22) Filed: Mar. 27, 2003

(51) Int. Cl.[7] ..... E03D 1/14
(52) U.S. Cl. ..... 4/325; 4/324; 4/326; 4/415
(58) Field of Search ..... 4/324–327, 345, 4/383, 389, 390, 415

(56) References Cited

U.S. PATENT DOCUMENTS 1,474,288 A 11/1923 Rath
2,351,672 A * 6/1944 William ..... 4/326
3,768,571 A 10/1973 Elder et al.
3,894,299 A * 7/1975 Cleary ..... 4/326
3,903,551 A 9/1975 Johnson
3,909,858 A 10/1975 Dunn, Jr.
4,042,962 A 8/1977 Yamaji et al.
4,115,881 A * 9/1978 Stone ..... 4/326
5,887,292 A 3/1999 Goren

* cited by examiner

*Primary Examiner*—Gregory L. Huson
*Assistant Examiner*—Khoa D. Huynh

(57) ABSTRACT

A dual flush toilet includes a handle pivotally mounted to a tank. A water outlet fluidly coupled to the tank has an upper edge defining a primary opening. An overflow tube is fluidly coupled to the water outlet. The overflow tube has a break therein such that a first section and a second section are defined. The first and second sections are positionable in a closed position mated together and an open, spaced position. A pivot assembly mechanically couples the second section to the handle such that the secorid section is removed from the first section when the handle is rotated in a first direction. A primary plug is mechanically coupled to the handle such that the primary plug is removed from the primary opening when the handle is rotated in a second direction.

6 Claims, 4 Drawing Sheets

DUAL FLUSH TOILET

BACKGROUND OF THE INVENTION

1. Field of the Invention

The present invention relates to flushing devices and more particularly pertains to a new flushing device for selecting between a relatively large flush of water and a small flush of water outward of a toilet tank.

2. Description of the Prior Art

The use of flushing devices is known in the prior art. U.S. Pat. No. 4,042,982 describes a dual flushing toilet having an outlet having a pair of openings. Another type of flushing device using a pair of openings is U.S. Pat. No. 3,909,856. Another method of utilizing varying sized flushes is found in U.S. Pat. No. 5,887,292 which includes a tank having an inner compartment for flushing a smaller portion of water than the tank contains.

While these devices fulfill their respective, particular objectives and requirements, the need remains for a device that utilizes the overflow outlet of toilet tank and can be readily retrofitted to existing toilet tanks.

SUMMARY OF THE INVENTION

The present invention meets the needs presented above by having an overflow tube having a break therein such that the overflow tube may be selectively opened at the break for partially releasing a quantity of water from the tank.

Another object of the present invention is to provide a new flushing device that includes a primary plug attached to a handle for wholly releasing the water located in the tank.

To this end, the present invention generally comprises a tank having a bottom wall and a peripheral wall that is attached to and extends upwardly therefrom. A handle is pivotally mounted in the peripheral wall and extends into the tank. A water outlet is fluidly coupled to the tank and extends upwardly through the bottom wall. The water outlet includes an inner section positioned within the tank and has a peripheral wall with an upper edge that defines a primary opening into the water outlet. An overflow tube is fluidly coupled to the peripheral wall of the inner section and extends upwardly therefrom. The overflow tube has an upper end defining an opening extending downward through the overflow tube and into the water outlet. The overflow tube has a break therein such that a first section and a second section are defined. The first and second sections are positionable in a closed position mated together and a spaced position wherein water positioned in the tank may exit the tank through a free end of the first section. A pivot assembly mechanically couples the second section to the handle such that the second section is removed from the first section when the handle is rotated in a first direction. A primary plug is removably positionable in the primary opening. The primary plug is mechanically coupled to the handle such that the primary plug is removed from the primary opening when the handle is rotated in a second direction.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
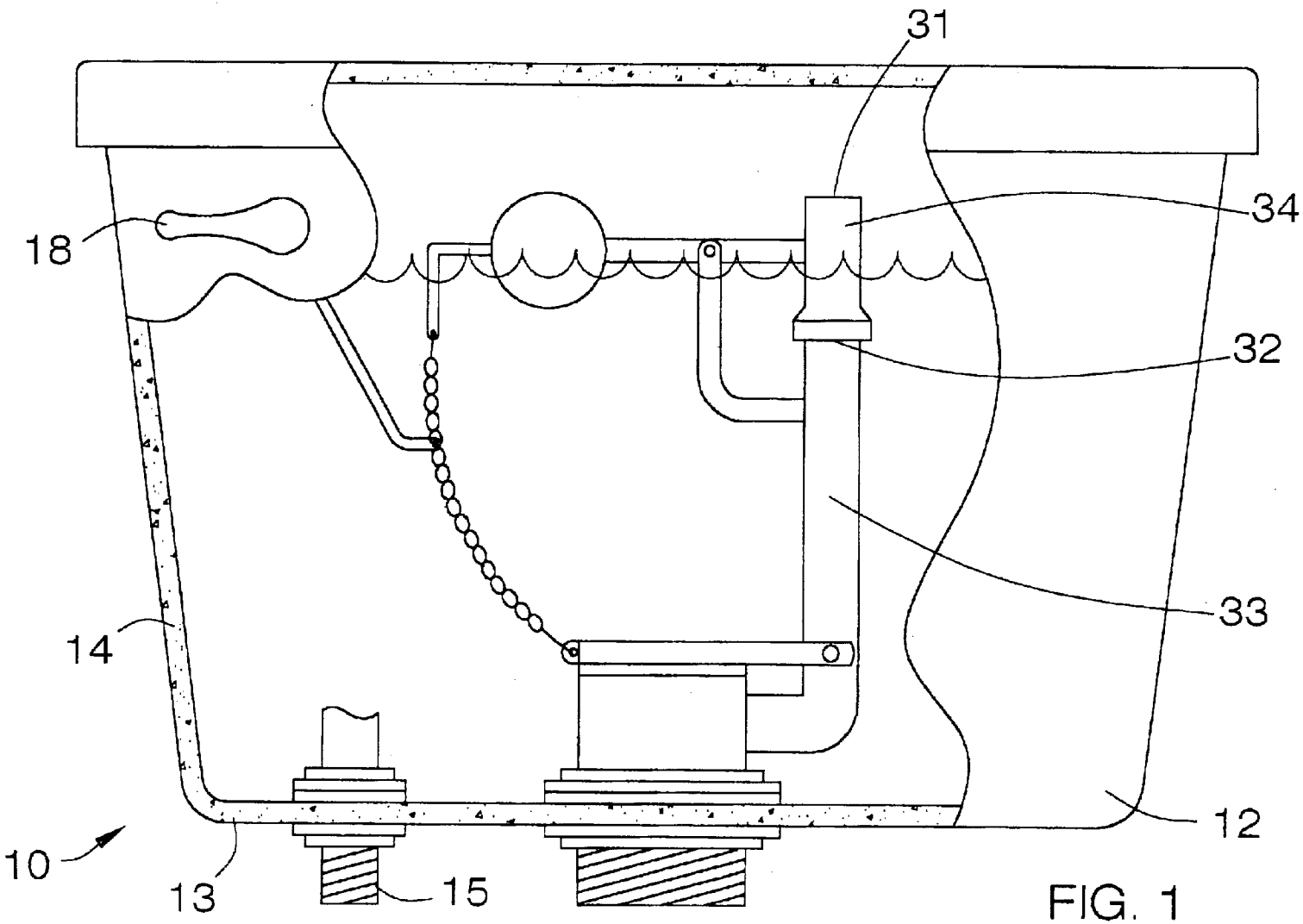
FIG. 1 is a schematic cut-away side view of a dual flush toilet according to the present invention.

With reference now to the drawings, and in particular to FIGS. 1 through 4 thereof, a new flushing device embodying the principles and concepts of the present invention and generally designated by the reference numeral 10 will be described.

As best illustrated in FIGS. 1 through 4, the dual flush toilet 10 generally comprises a tank 12 having a bottom wall 13 and a peripheral wall 14 that is attached to and extends upwardly therefrom. The tank 12 is conventional of the types used for toilets and preferably includes a water inlet 15 and a valve assembly, not shown, for controlling the refilling of water into the tank 12 after it has been flushed.

A handle 18 is pivotally mounted in the peripheral wall 14 and extends into the tank 12. An elongated member 19 is positioned in the tank 12 and has a first end 20 attached to the handle 18 and a second end 21 extending away from the handle 18.

A water outlet 24 is fluidly coupled to the tank 12 and extends upwardly through the bottom wall 13. The water outlet 24 includes an inner section 25 positioned within the tank 12. The inner section 25 includes a peripheral wall 26 with an upper edge 27. The upper edge 27 defines a primary opening into the water outlet.

Figure 2:
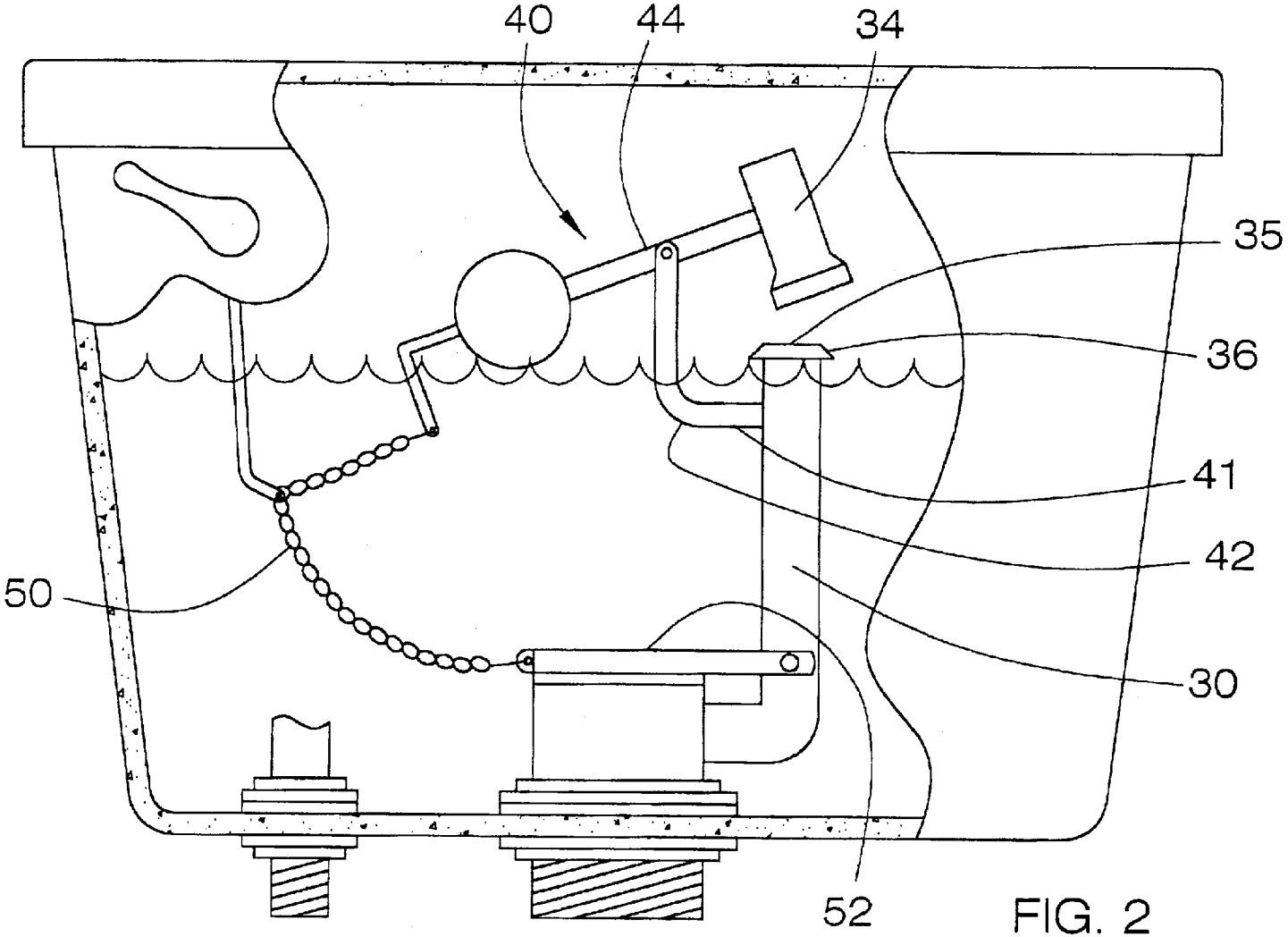
FIG. 2 is a schematic side view of the present invention.
Figure 3:
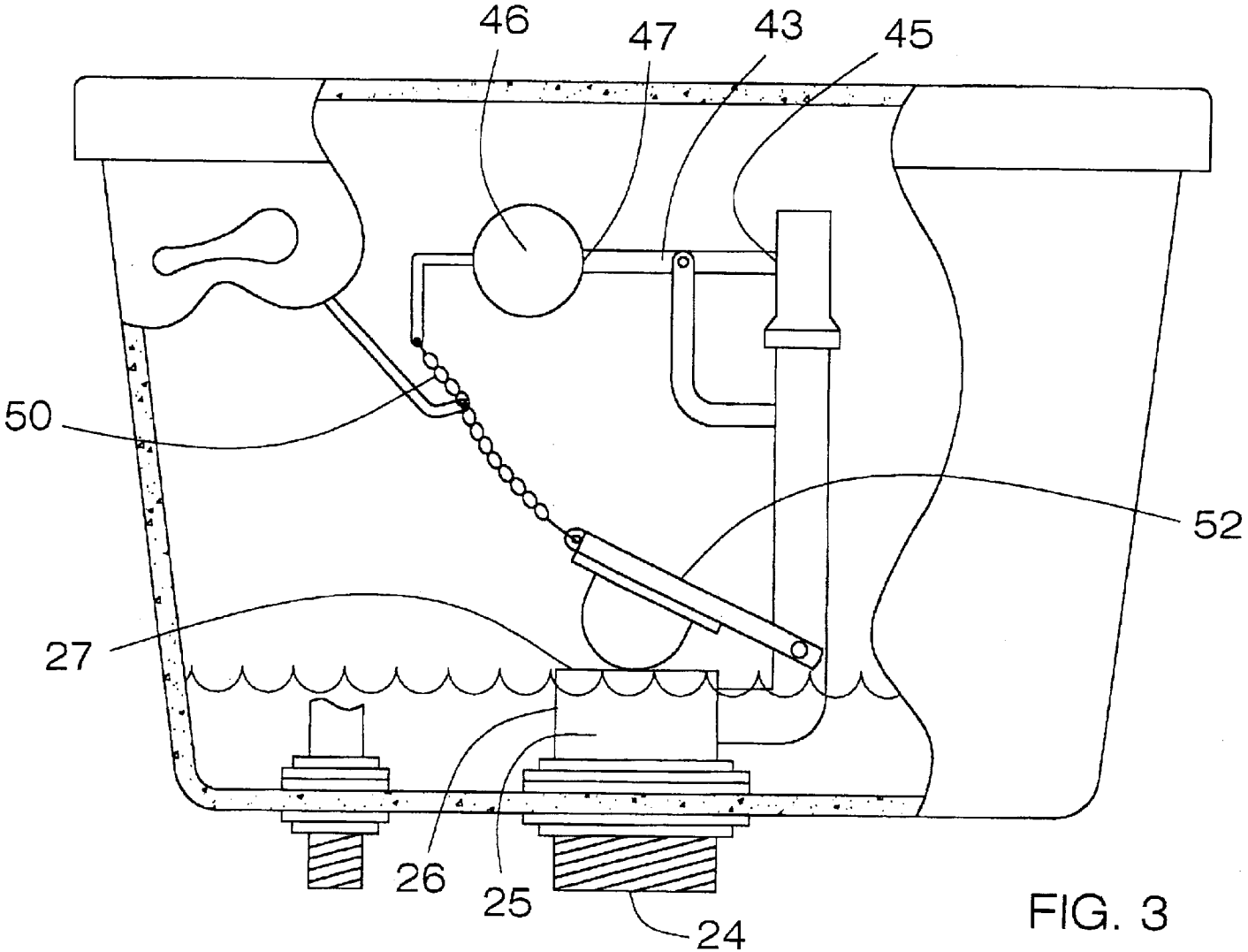
FIG. 3 is a schematic side view of the present invention.
Figure 4:
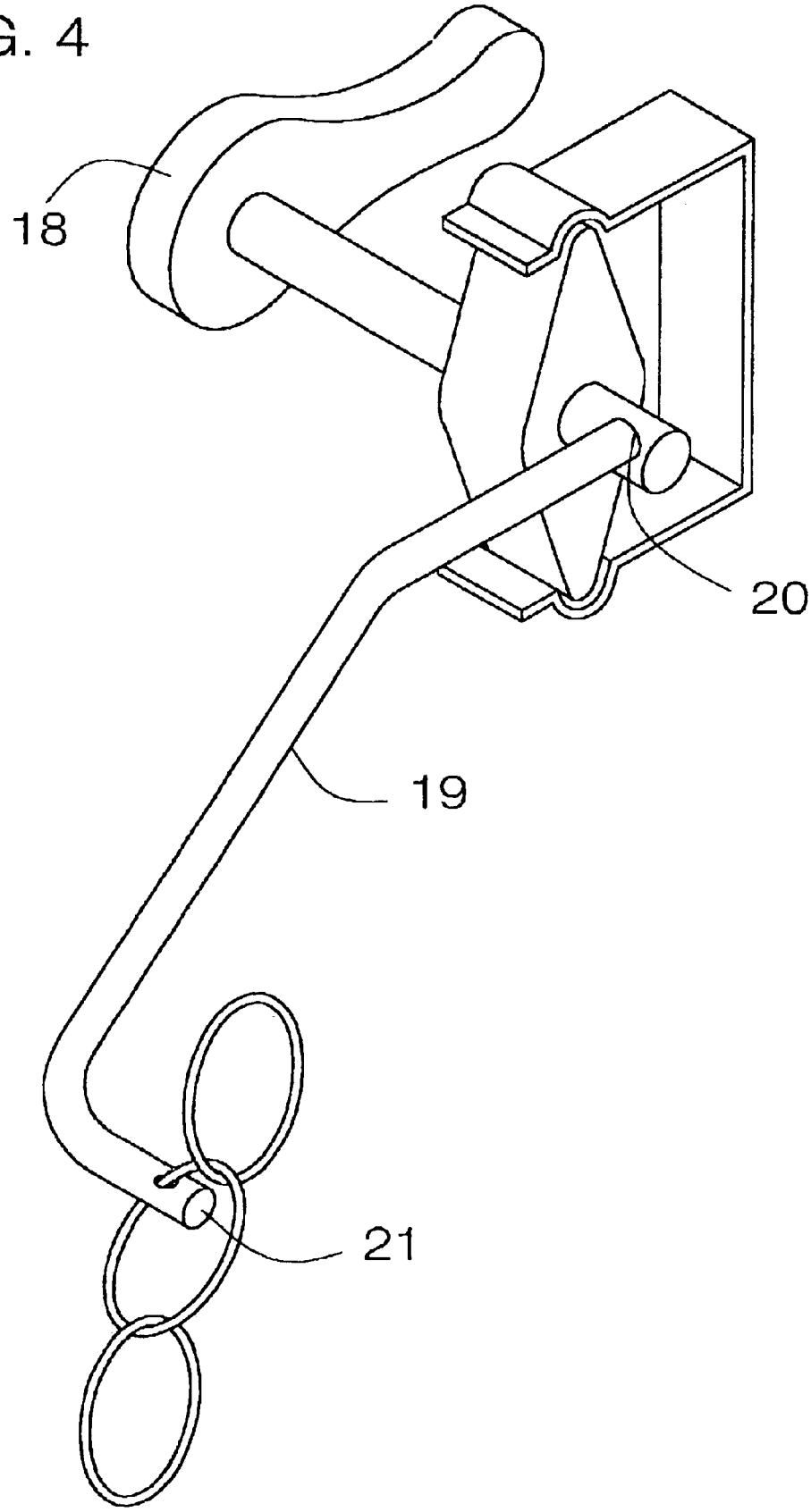
FIG. 4 is a schematic perspective view of the handle of the present invention.

An overflow tube 30 is fluidly coupled to the peripheral wall 26 of the inner section 25 and extends upwardly therefrom. The overflow tube 30 has an upper end 31 defining an opening extending downward through the overflow tube 30 and into the water outlet 24. The overflow tube 30 has a break 32 therein such that a first section 33 and a second section 34 are defined. The first 33 and second 34 sections are positionable in a closed position mated together, as shown in FIG. 3, and an open position spaced apart, as shown in FIG. 2, wherein water positioned in the tank 12 may exit the tank 12 through a free end 35 of the first section 33. Preferably, a seal 36 is attached to and extends around the free end 35. The free end 35 is positioned higher than the primary opening 27 with respect to the bottom wall 13.

A pivot assembly 40 mechanically couples the second section 34 to the handle 18 such that the second section 34 is removed from the first section 33 when the handle 18 is rotated in a first direction. The pivot assembly 40 includes a pivot member 41 that is attached to and extends away from the first section 33. The pivot member 41 includes an arm having a bend 42 therein such that the arm extends away and upwardly from the first section 33. A rod 43 is pivotally coupled to an upper end 44 of the arm, or pivot member 41. A first end 45 of the rod 43 is attached to the second section 34. A float 46 is attached to a second end 47 of the rod 43. The upper end 44 of the pivot member 41 is positioned between the first 45 and second 47 ends of the rod 43. The float 46 is buoyant in water and has a weight greater than the second section 34. This is necessary if the upper end 44 is positioned exactly between the first 45 and second 47 ends of the rod 43. If the upper end 44 pivot member 41 is positioned either closer to, or further away from the first end 45, the weight of the float 46 will need to be altered to ensure that it has sufficient weight to support the second section 34 in the open position. A tether 50 is attached to and extends between the float 47 and the second end 21 of the elongated member 19. The tether 50 may include any elongated flexible member such as a chain or cord.

A primary plug 52 is removably positionable in the primary opening 27. The primary plug 52 is mechanically coupled to the second end 21 of the elongated member 19 such that the primary plug 52 is removed from the primary opening 27 when the handle 18 is rotated in a second direction. To achieve this, the tether 50 extends between and is attached to the second end 21 of the elongated member 19 and the primary plug 52 such that the tether 50 lifts the primary plug 52 upwardly away from the primary opening 27. The primary plug 52 is hingedly coupled to the overflow tube 30 and positioned over the primary opening 27 such that the primary plug 52 may fall onto the primary opening 27 when a water level within the tank 12 is substantially equal to a level of the primary opening 27. In general, the primary plug 52 works like a conventional flapper plug found in typical toilet tanks.

In use, when a user of the device 10 uses a toilet fluidly coupled to the tank 12, the user may choose either a large flush of water from the tank or a relatively small flush of water from the tank 12. To select the small, or partial, flush, the user rotates the handle 18 in a first direction to pull the float 46 down which in turn pivots the second section 34 upwardly away from the first section 33. This forms an opening into which water may enter the first section 33 and flow outward of the tank 12. As the water returns to its required fill level, the float 46 moves upward and the second section 34 will mate with the first section 33. For a large flush, the user rotates the handle 18 in a second direction to lift the primary plug 27 to wholly flush the water outward of the tank 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A dual flush toilet comprising:

a tank having a bottom wall and a peripheral wall being attached to and extending upwardly therefrom;

a handle being pivotally mounted in said peripheral wall and extending into said tank;

a water outlet being fluidly coupled to said tank and extending upwardly through said bottom wall, said water outlet including an inner section positioned within said tank, said inner section including a peripheral wall with an upper edge, said upper edge defining a primary opening into said water outlet;

an overflow tube being fluidly coupled to said peripheral wall of said inner section and extending upwardly therefrom, said overflow tube having an upper end defining an opening extending downward through said overflow tube and into said water outlet, said overflow tube having a break therein such that a first tubular section and a second tubular section are defined said upper end opening located in said second section, said first and second tubular sections being positionable in a closed position mated together and a spaced position wherein water positioned in said tank may exit said tank through a free end of said first section;

a pivot assembly mechanically coupling said second section to said handle such that said second section is removed from said first section when said handle is rotated in a first direction; and a primary plug being removably positionable in said primary opening, said primary plug being mechanically coupled to said handle such that said primary plug is removed from said primary opening when said handle is rotated in a second direction.

2. The dual flush toilet of claim 1, further including an elongated member being positioned in said tank and having a first end attached to said handle and a second end extending away from said handle, a tether being attached to and extending between said pivot assembly and said second end of said elongated member, said tether extending between and being attached to said primary plug and said second end of said elongated member.

3. The dual flush toilet of claim 1, further including a seal being attached to and extending around said free end.

4. The dual flush toilet of claim 2, wherein said pivot assembly includes:

a pivot member being attached to and extending away from said first section, said pivot member including an arm having a bend therein such that said arm extends away and upwardly from said first section;

a rod being pivotally coupled to an upper end of said arm, a first end of said rod being attached to said second section;

a float being attached to a second end of said rod, said upper end of said pivot member being positioned between said first and second ends of said rod, said float being buoyant and having a weight greater than said second section;

said tether being attached to and extending between said float and said second end of said elongated member.

5. The dual flush toilet of claim 2, wherein said primary plug is hingedly coupled to said overflow tube and positioned over said primary opening such that said primary plug may fall onto said primary opening when a water level within said tank is substantially equal to a level of said primary opening.

6. A dual flush toilet comprising:

a tank having a bottom wall and a peripheral wall being attached to and extending upwardly therefrom;

a handle being pivotally mounted in said peripheral wall and extending into said tank, an elongated member being positioned in said tank and having a first end attached to said handle and a second end extending away from said handle;

a water outlet being fluidly coupled to said tank and extending upwardly through said bottom wall, said water outlet including an inner section positioned within said tank, said inner section including a peripheral wall with an upper edge, said upper edge defining a primary opening into said water outlet;

an overflow tube being fluidly coupled to said peripheral wall of said inner section and extending upwardly therefrom, said overflow tube having an upper end defining an opening extending downward through said overflow tube and into said water outlet, said overflow tube having a break therein such that a first tubular section and a second tubular section are defined, said first and second sections being positionable in a closed position mated together and an open position spaced apart wherein water positioned in said tank may exit said tank through a free end of said first section, a seal being attached to and extending around said free end, said free end being positioned higher than said primary opening with respect to said bottom wall;

a pivot assembly mechanically coupling said second section to said handle such that said second section is removed from said first section when said handle is rotated in a first direction, said pivot assembly including;

a pivot member being attached to and extending away from said first section, said pivot member including an arm having a bend therein such that said arm extends away and upwardly from said first section;

a rod being pivotally coupled to an upper end of said arm, a first end of said rod being attached to said second section;

a float being attached to a second end of said rod, said upper end of said pivot member being positioned between said first and second ends of said rod, said float being buoyant and having a weight greater than said second section;

a tether being attached to and extending between said float and said second end of said elongated member;

a primary plug being removably positionable in said primary opening, said primary plug being mechanically coupled to said second end of said elongated member such that said primary plug is removed from said primary opening when said handle is rotated in a second direction, said tether extending between said second end of said elongated member and said primary plug such that said tether may lift said primary plug upwardly away from said primary opening, said primary plug being hingedly coupled to said overflow tube and positioned over said primary opening such that said primary plug may fall onto said primary opening when a water level within said tank is substantially equal to a level of said primary opening.

* * * * *